US007546800B2

(12) United States Patent
Caron

(10) Patent No.: US 7,546,800 B2
(45) Date of Patent: Jun. 16, 2009

(54) ROLLER PRESS FOR EMBELLISHING SHEET MEDIA

(75) Inventor: James Jeffery Caron, Solon, OH (US)

(73) Assignee: Spellbinders Paper Arts Co. LLC, Peoria, AZ (US)

( * ) Notice: Subject to any disclaimer, the term of this patent is extended or adjusted under 35 U.S.C. 154(b) by 432 days.

(21) Appl. No.: 11/054,051

(22) Filed: Feb. 9, 2005

(65) Prior Publication Data

US 2006/0174783 A1 Aug. 10, 2006

(51) Int. Cl.
*B41F 1/07* (2006.01)

(52) U.S. Cl. ..... 101/3.1; 101/16; 101/23; 101/28

(58) Field of Classification Search ..... 101/3.1, 101/16, 23, 28, 30, 32
See application file for complete search history.

(56) References Cited

U.S. PATENT DOCUMENTS

| | | | | |
|---|---|---|---|---|
| 2,088,686 | A * | 8/1937 | Blanchard, Jr. | 83/45 |
| 2,578,686 | A | 12/1951 | Fish | |
| 3,561,353 | A * | 2/1971 | Curran | 101/65 |
| 3,688,377 | A * | 9/1972 | Kaiser et al. | 29/243.53 |
| 3,935,811 | A | 2/1976 | Lenz et al. | |
| D257,777 | S | 1/1981 | Eichenberg et al. | |
| D296,565 | S | 7/1988 | Eichenberg et al. | |
| 5,255,587 | A | 10/1993 | Eichenberg et al. | |
| D341,842 | S | 11/1993 | Eichenberg et al. | |
| 5,319,430 | A * | 6/1994 | DeBolt et al. | 399/322 |
| D359,967 | S | 7/1995 | Eichenberg et al. | |
| 5,628,226 | A | 5/1997 | Weissman | |
| 5,647,260 | A * | 7/1997 | Nabity | 83/522.12 |
| 5,662,574 | A * | 9/1997 | Slotten | 492/56 |
| 5,775,213 | A | 7/1998 | Hyde | |
| 6,220,136 | B1 * | 4/2001 | Benes et al. | 83/566 |
| 6,517,655 | B1 * | 2/2003 | Spencer et al. | 156/227 |
| 6,619,195 | B2 | 9/2003 | Corcoran et al. | |
| 2002/0178935 | A1 | 12/2002 | Corcoran et al. | |
| 2003/0019370 | A1 | 1/2003 | Corcoran et al. | |
| 2004/0112196 | A1 | 6/2004 | Corcoran et al. | |

* cited by examiner

*Primary Examiner*—Daniel J Colilla
*Assistant Examiner*—Marissa L Ferguson-Samreth
(74) *Attorney, Agent, or Firm*—Fay Sharpe LLP

(57) ABSTRACT

A new and improved roller press for embellishing media includes a pair of spaced apart roller press members having convex shaped radially outer press surfaces. A handle having a ratchet mechanism is connected to a first roller for turning the roller during pressing. A gear set connects the rollers for turning a second roller in a rotational direction opposite of the first roller for moving the media between the rollers for pressing. A feed bed and exit bed slope away from the rollers to provide a stable base for supporting the press.

33 Claims, 5 Drawing Sheets

ROLLER PRESS FOR EMBELLISHING SHEET MEDIA

BACKGROUND

The present invention relates to an apparatus for embellishing media, and more particularly to a roller press for embossing and/or die cutting sheet media.

The papercraft and scrapbook industry has become widely popular seeing explosive growth in recent years. Many people have taken up the hobby of keeping mementos and photos in scrapbooks and they wish to personalize their collections using embellished media, such as die cut and/or embossed paper, foils, and the like.

For this task, the media is typically embellished by pressing it against a template, such as a die. It is desirable to provide a simple, portable press for effectively pressing media against a template for embellishing it.

SUMMARY OF THE INVENTION

According to the present invention, a new and improved roller press for embellishing media is provided.

In accordance with a first aspect of the invention, the roller press includes a pair of spaced apart bearing blocks, first and second roller press member having convex shaped radially outer press surfaces disposed in a spaced apart relationship for pressing the media therebetween.

In accordance with a second aspect of the invention, the roller press includes a handle for receiving rotational forces applied by a user, the handle having a ratchet mechanism connected to the first roller for transferring rotational forces between the handle and the first roller, the ratchet mechanism providing engaged action for turning the first roller in a first rotational direction $R_1$ as the handle is moved in a first direction $H_1$ and freewheeling action for not turning the first roller as the handle is moved in a second direction $H_2$ opposite the first direction $H_1$.

In accordance with another aspect of the invention, the press includes a gear set connecting the first and second rollers for turning the second roller in a rotational direction opposite of the first roller for moving the media between the rollers for pressing.

In accordance with another aspect of the invention the roller press includes a feed bed connected to the bearing blocks for supporting media for movement in a feed direction towards the rollers, the feed bed having a first end disposed adjacent to the rollers and a second end disposed opposite the first end providing a base for supporting the press.

In accordance with another aspect of the invention the roller press includes an exit bed connected to the bearing blocks for supporting media for movement away from the rollers, the exit bed having a first end disposed adjacent to the rollers opposite the feed bed and a second end disposed opposite the first end providing a base for supporting the press.

The advantages and benefits of the present invention will become apparent to those of ordinary skill in the art upon reading and understanding the following detailed description of the preferred embodiments.

BRIEF DESCRIPTION OF THE DRAWINGS

The invention may take form in certain components and structures, preferred embodiments of which will be illustrated in the accompanying drawings wherein.

DETAILED DESCRIPTION OF THE INVENTION

Figure 1:
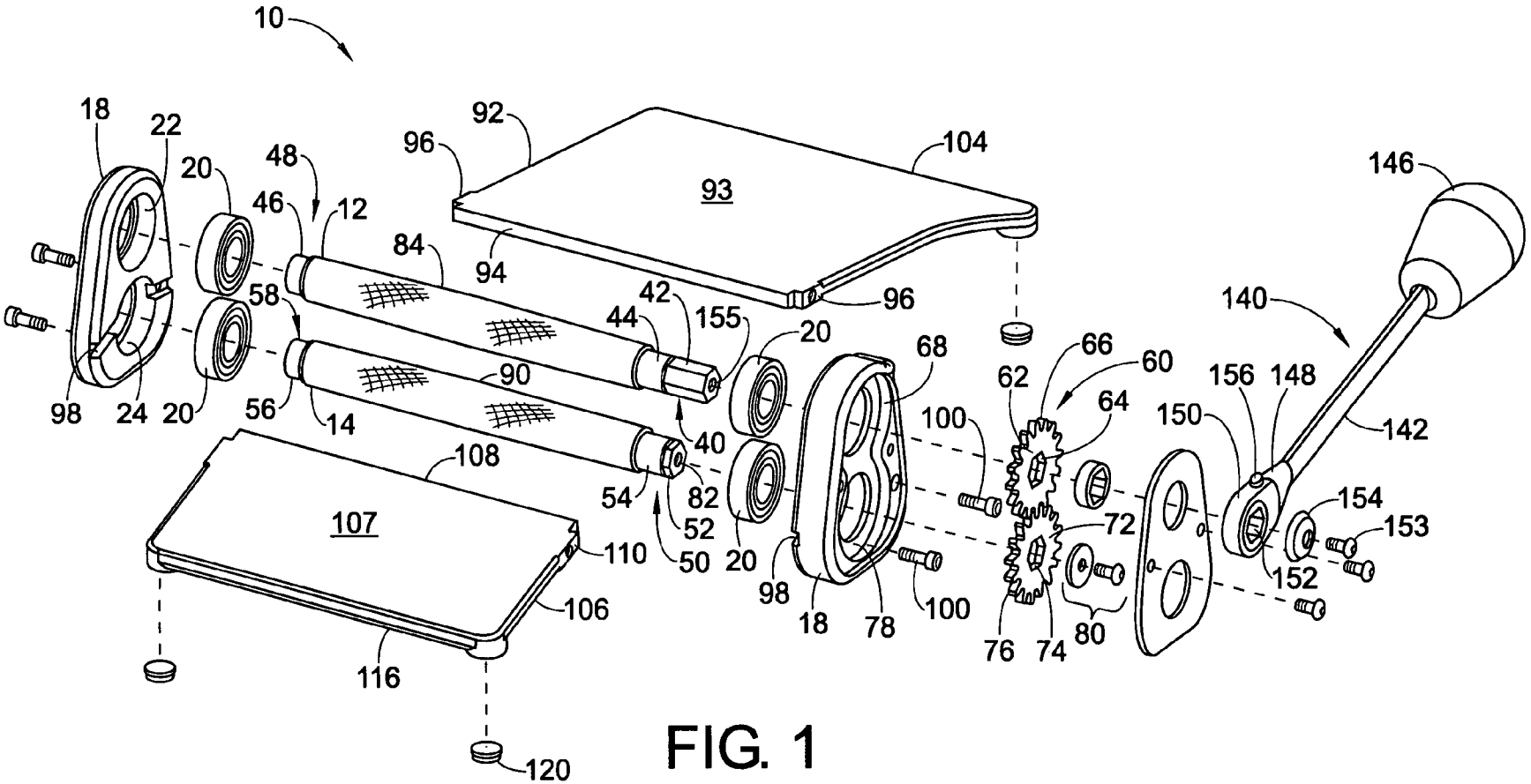
FIG. 1 is an exploded perspective view of the press in accordance with the invention.

It is to be understood that the specific devices and processes illustrated in the attached drawings, and described in the following specification are simply exemplary embodiments of the inventive concepts defined in the appended claims. Hence, specific examples and characteristics relating to the embodiments disclosed herein are not to be considered as limiting, unless the claims expressly state otherwise.

The term "embellish" as used herein refers to altering the appearance of media by cutting the media, such as for example by die cutting with a template, and/or by embossing the media. The term "embossing" as used hereinafter refers to forming a three dimensional impression of a template in the media. The template can be a media embellishing die which can include a cutter and/or embossing surface for embellishing media. Alternatively, the template may not be a die, but rather another three dimensional object capable of embossing media when pressed with the media. The embossing is dry embossing which does not use heat. The media can be any sheet material suitable for embellishing including, but not limited to, paper, card stock, cardboard, metal, such as for example metal foil or other thin metals, and plastic, among others.

Referring to FIGS. 1-4, a roller press for embellishing media is shown generally at 10. The press 10 includes a first roller press member 12 and a second roller press member 14 spaced apart from the first roller for pressing sheet media 16 and a template 17 therebetween to embellish the media as described in further detail below. The rollers 12 and 14 are formed of a rigid material capable of providing high press forces (illustrated by arrows P in FIG. 7) to the materials pressed therebetween. An example of a material suitable for forming the rollers can include, but is not limited to, metal such as steel, and more particularly 1144 steel. The rollers 12, 14 can be solid and formed by machining the metal or other material, however it should be appreciated that hollow rollers can be used.

The press 10 also includes a pair of spaced apart bearing blocks 18 housing bearings 20 for supporting the rollers 12, 14 for rotation. The bearing blocks 18 are rigid and can be formed of aluminum, steel, or other metals, composite materials including strong plastics and the like, or other materials capable of withstanding strong forces tending to move the rollers 12, 14 away from each other when pressing. In the example provided herein, each of the bearing blocks 18 are machined from aluminum and include an upper bearing socket 22 and lower bearing socket 24, disposed beneath the upper bearing socket, for housing the bearings 20. The bearing sockets 22 and 24 are disposed in the sides of the spaced apart bearing blocks 18 that face each other. The bearing sockets 22 and 24 of only one of the bearing blocks 18 are visible in FIG. 1. The bearings 20 can be ball bearings, roller bearings, or other suitable bearings capable of withstanding strong radial forces while providing for smooth rotation of the rollers 12, 14 during pressing.

Figure 5:
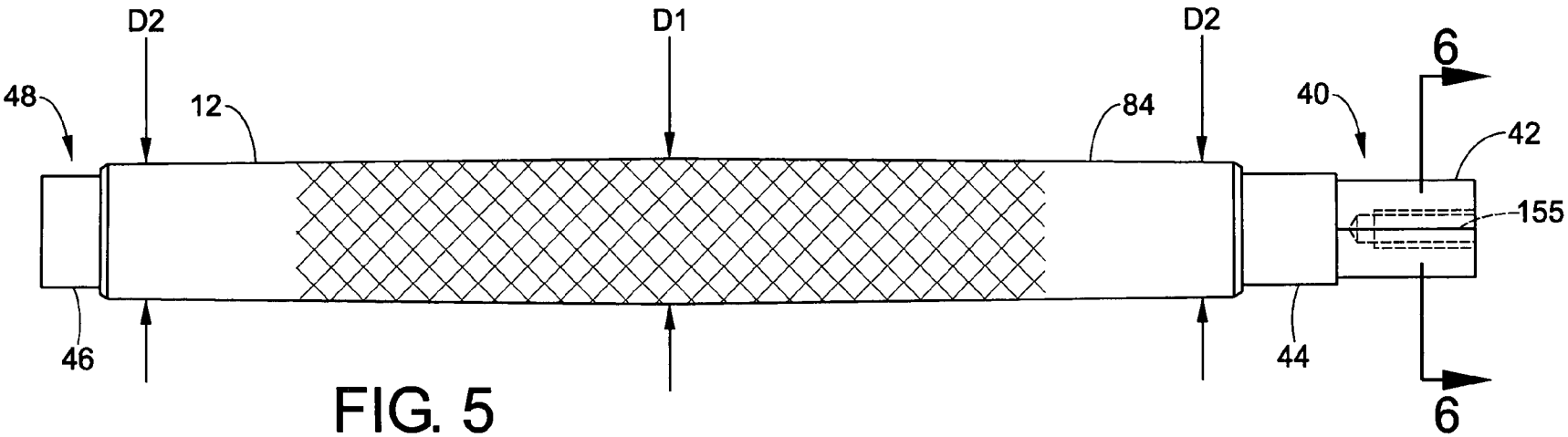
FIG. 5 is an elevational side view of the first roller illustrating the convex shaped press surface.
Figure 6:
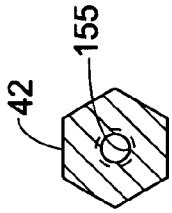
FIG. 6 is a sectional view of the first end of the first roller illustrating the cross sectional shape of the keyed surface.

Referring now to FIGS. 1, 5 and 6, the first roller 12 includes a first end 40 having a keyed surface 42. The keyed surface 42 has a hexagonal cross sectional shape, though other cross sectional shapes can be used. The first roller 12 also includes a cylindrical bearing seat surface 44, disposed adjacent the keyed surface 42, which is received in the bearing 20 to provide for rotation of the roller during pressing. The first roller 12 also includes a cylindrical bearing seat surface 46 disposed at the second end 48 of the roller which is received in the bearing 20 disposed in the other bearing block 18.

In reference to FIG. 1, the second roller 14 also includes a first end 50 having a keyed surface 52. The keyed surface 52 has a hexagonal cross sectional shape, though again, other cross sectional shapes can be used. The keyed surface 52 has a shorter axial length than the keyed surface 42 of the first roller 12. The second roller 14 also includes a cylindrical bearing seat surface 54, disposed adjacent the keyed surface 52, which is received in the bearing 20 to provide for rotation of the roller during pressing. The second roller 14 also includes a cylindrical bearing seat surface 56 disposed at the second end 58 of the roller. The bearing seat surfaces 44 and 46 on the first roller 12 are spaced apart a similar distance from each other as the bearing seat surfaces 54 and 56 on the second roller 14 corresponding to the spaced apart locations of the bearings 20 disposed in the bearing blocks 18.

Figure 2:
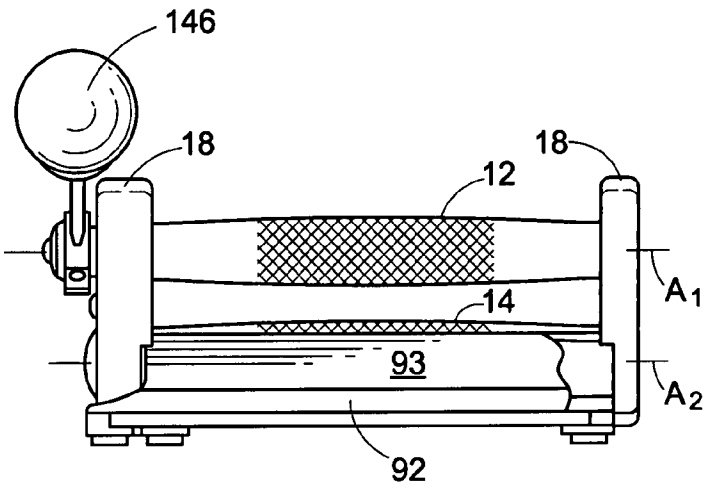
FIG. 2 is a front elevational view of the press illustrating how the first roller is spaced apart from the second roller for pressing the media therebetween.
Figure 3:
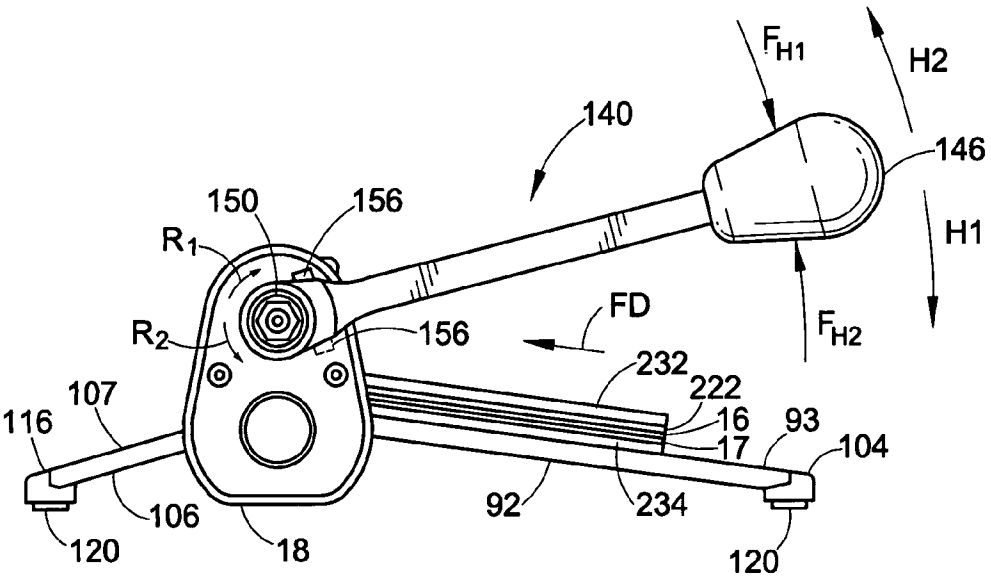
FIG. 3 is a side elevational view of the press illustrating the handle and ratchet mechanism as well as showing material moving in a feed direction on the feed bed.
Figure 4:
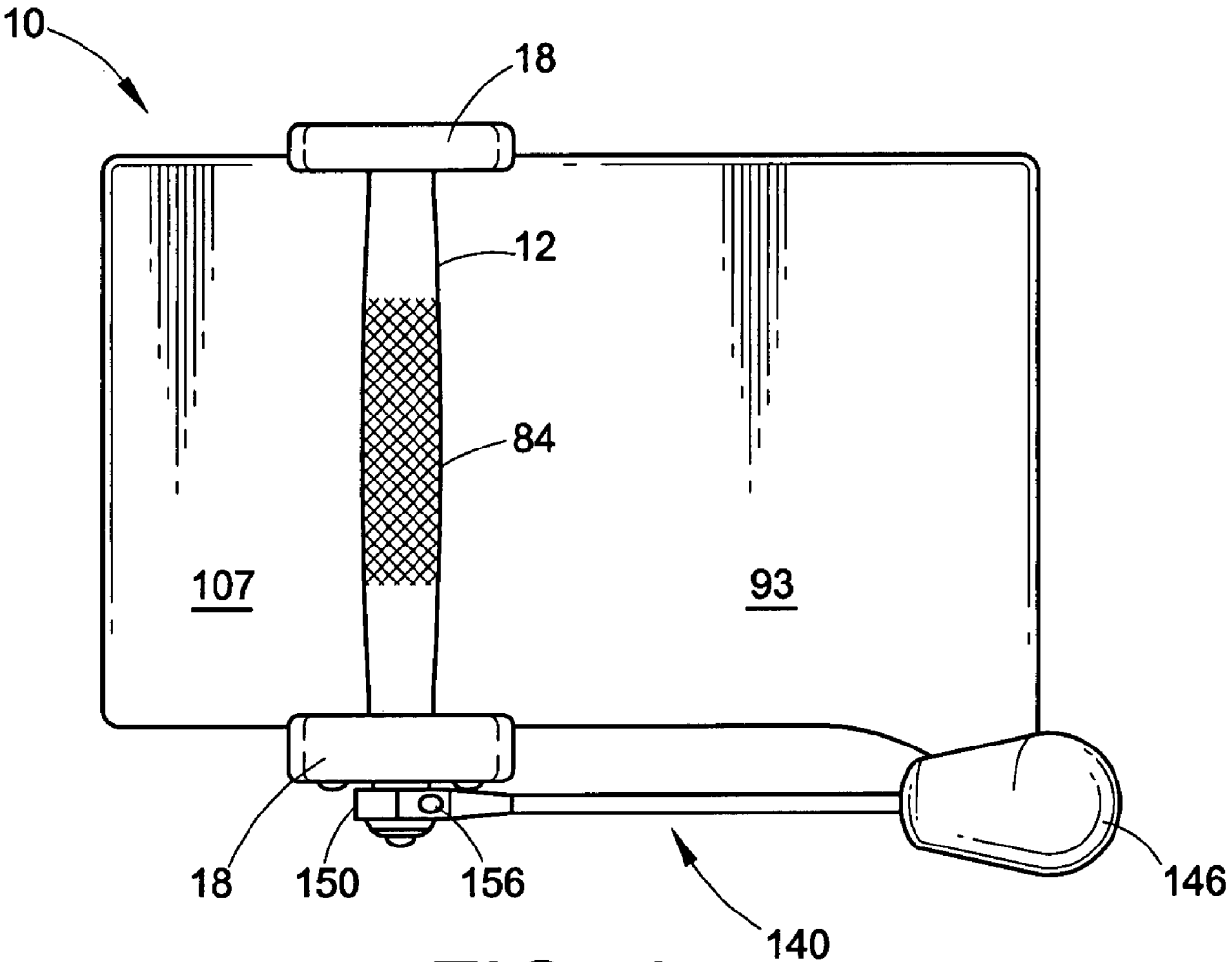
FIG. 4 is a top view of the press.

Referring now to FIGS. 1-3, the bearing seat surfaces 44, 46, 54, and 56 are received in the bearings 20 which provide for rotation of the rollers 12 and 14 about axes $A_1$ and $A_2$ as shown in FIG. 2. The rollers 12, 14 are supported by the bearing blocks 18 in a spaced apart orientation such that the axes of rotation $A_1$, $A_2$ are generally parallel and the first roller is disposed above the second roller. The rigid bearing blocks 18 and the bearings 20 withstand the forces generated during pressing that tend to spread the rollers apart thereby keeping the rollers 12, 14 and the axes of rotation $A_1$, $A_2$ separated by fixed distances.

The press 10 also includes a gear set 60 connecting the first roller 12 and the second roller 14 for transferring rotational forces therebetween to turn the second roller in a rotational direction that is opposite of the rotational direction of the first roller for moving the media 16 between the rollers for pressing. The gear set 60 includes a circular first gear 62 having a centrally disposed aperture 64. The aperture 64 has a shape, hexagonal in the example provided herein, which is complimentary to the first roller keyed surface 42 thereby forming a mating surface for receiving the keyed surface therein. The complimentary shaped mating surface of the aperture 64 abuts the first roller keyed surface 42 providing a force transferring connection between the first gear 62 and the first roller 12 which prevents one from rotating relative to the other. The first gear 62 has gear teeth 66 extending around the circumference of the gear. The first gear 62 is received within an upper gear socket 68 formed in the bearing block 18.

The gear set 60 also includes a circular second gear 72 having a centrally disposed aperture 74. The aperture 74 has a shape, also hexagonal in this example, which is complimentary to the second roller keyed surface 52 thereby forming a mating surface for receiving the keyed surface therein. The aperture's complimentary shaped mating surface 74 abuts the second roller keyed surface 52 providing a force transferring connection between the second gear 72 and the second roller 14 which prevents one from rotating relative to the other. The second gear 72 is received within a lower gear socket 78 formed in the bearing block 18. The second gear 72 has gear teeth 76 extending around the circumference of the gear for meshing with the gear teeth 66 of the first gear. The second gear 72 is retained on the second roller by a fastener 80, such as a bolt and washer, that is received in a threaded hole 82 disposed on the end of the second roller 14. It should be appreciated that the gear set 60 can include other gears and gear arrangements suitable for transferring rotational forces from the first roller 12 to the second roller 14 to turn the second roller in a rotational direction that is opposite of the rotational direction of the turning first roller.

The first roller 12 has a radially outer press surface 84 disposed between the bearing seat surfaces 44 and 46. The press surface 84 is convex-shaped, which can also be referred to as barrel-shaped, having a central diameter D1 that is larger than the diameters of the axially outer ends of the press surface 84, referred to herein as the end diameters D2, as illustrated in FIG. 6. In the example provided herein, the end diameters D2 are approximately equal and are about 0.713 inches. The central diameter D1 is about 2% to about 10% larger than the end diameters D2, and in this example is about 0.0745 inches, however, it should be appreciated that these diameters are provided for the purposes of example.

The second roller 14 can also have a convex shaped press surface 90 similar to the first roller press surface 84. Forming the rollers 12 and 14 with convex-shaped press surfaces 84 and 90 reduces the amount that the rollers bend or deflect away from each other along their axial direction during pressing. This enables the rollers 12 and 14 to provide press forces P of a more consistent magnitude along their axial length, even at their centers which are spaced farthest from their load bearing ends 40, 48, 50 and 58.

The roller press surfaces 84 and 90, or portions thereof, can be knurled as shown to increase frictional forces between the rollers 12, 14 and the materials being pressed. The frictional forces move the materials through the press as the rollers 12, 14 turn and reduce or eliminate slippage between the materials and the rollers.

The press 10 also includes a feed bed 92 disposed between the bearing blocks 18. The feed bed 92 includes a feed surface 93 for supporting the media 16, and other materials to be pressed, for movement in a feed direction, shown by arrow FD, towards the rollers 12, 14 for pressing. The feed surface 93 can be flat. The feed bed 92 includes a first end 94 disposed adjacent to the rollers 12, 14 such that the feed surface 93 is just slightly below the top of the press surface 90 of the second roller. The sides 96 of the first end 94 are received in grooves 98 formed in the bearing blocks 18 and connected to the bearing blocks by fasteners 100, such as bolts or the like. The feed bed 92 also includes a second end 104, disposed opposite the first end 94, forming a base for supporting the press 10.

The press 10 also includes an exit bed 106 disposed between the bearing blocks 18. The exit bed 106 includes an exit surface 107 for supporting materials, such as the media, template, etc., for movement away from the rollers 12, 14 and out of the press after pressing. The exit surface 107 can be flat. The exit bed 106 also includes a first end 108 disposed adjacent to the rollers 12, 14 opposite the feed bed first end 94. The exit surface 107 is disposed slightly below the top of the second roller press surface 90. The sides 110 of the first end 108 are received in grooves 112 formed in the bearing blocks 18 and connected to the bearing blocks by fasteners 100, such as bolts or the like. The exit bed 106 also includes a second end 116, disposed opposite the first end 108, forming a base for supporting the press 10.

The feed and exit bed second ends, 104 and 116, can include feet 120 formed of a material having a high coefficient of friction to reduce or prevent movement of the entire press 10 during pressing. The material forming the feet 120 can also be resilient to protect the surface supporting the press 10. Examples of materials suitable for forming the feet 120 can include, but are not limited to rubber, vinyl, sponge rubber, and soft plastics, among others.

The feed bed 92 and exit bed 106 are oriented to slope downwards moving from the first ends 94, 108 towards the second ends 104, 116 to form a triangle having sides which include the feed bed, the exit bed and the surface the press 10 rests on. The grooves 98 in the bearing blocks receiving the first end sides 96 and 110 can be angled to provide this sloped orientation for the exit and feed beds. Sloping the feed and exit beds 92, 106 away from the rollers 12, 14 enables the second roller to extend beneath the beds while providing a stable base for supporting the press 10. This configuration of the feed and exit beds allows the user to apply large forces $F_{H1}$ to the handle 140 which generate large press forces P as described below, while providing significant stability to prevent the press 10 from tipping over.

Figure 7:
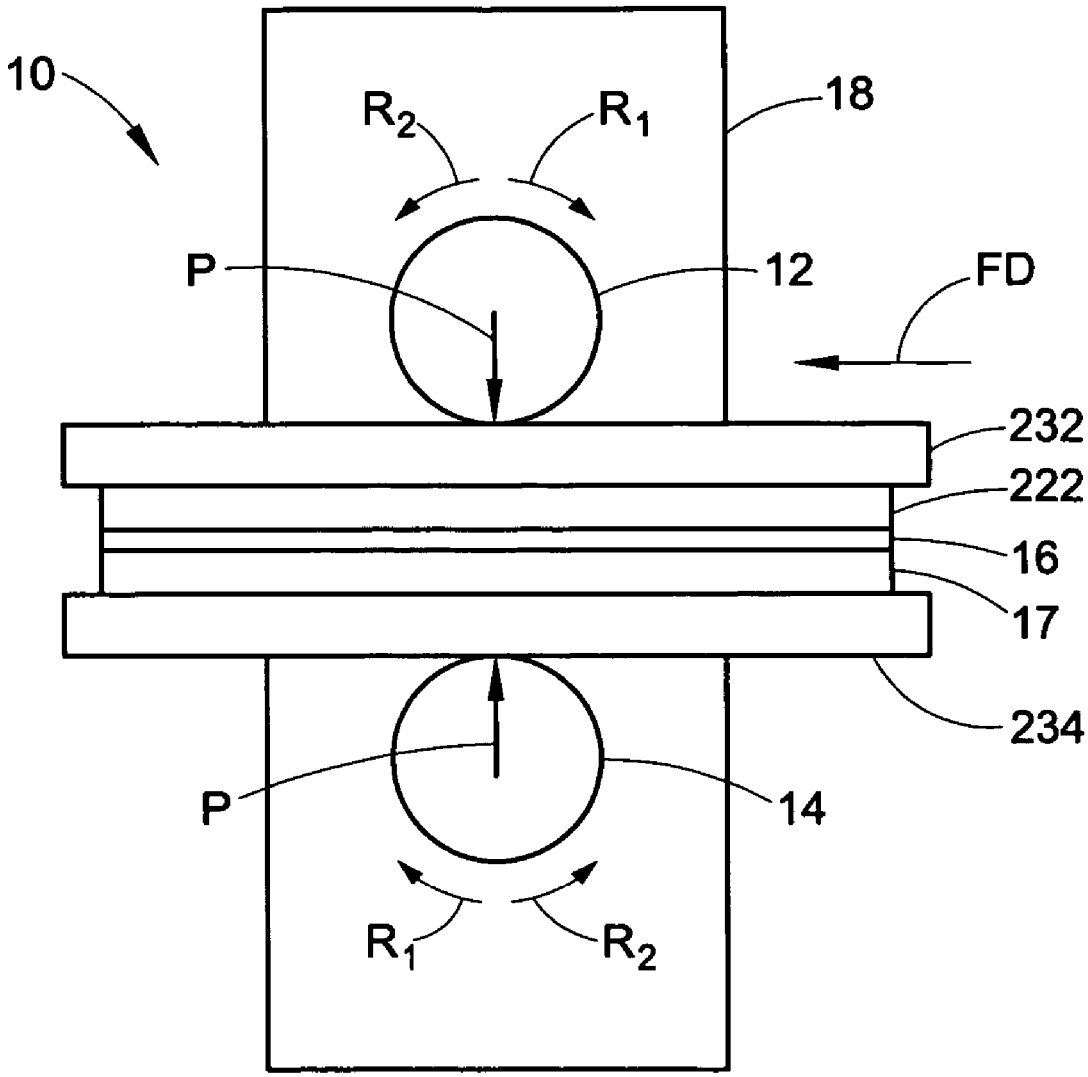
FIG. 7 is a block diagram illustrating the press forces applied to materials including sheet media during pressing.

Referring now to FIGS. 1, 3 and 7, the press 10 also includes a handle 140 for receiving rotational forces $F_{H1}$ and $F_{H2}$ applied by a user. The handle 140 can be a lever arm 142 having a first end 144 having a grab surface 146 and a second end 148. The handle 140 includes a ratchet mechanism 150 disposed at the second end 148 that is connected to the first roller first end 40 for transferring rotational forces from the handle to the first roller 14 for turning the first roller. The ratchet mechanism 150 can be disposed in the handle 140, as shown in FIG. 1. The ratchet mechanism 150 includes an aperture having a mating surface 152 with a shape that is complimentary to the first roller keyed surface 42. The first roller 12 extends through the bearing block 18 such that the key surface 42 extends therefrom. The key surface 42 extends into the ratchet aperture and abuts the mating surface 152 for providing a force transferring connection between the handle 140 the first roller 12. A bolt 153 extends through a washer 154 into a threaded aperture 155 in the first roller first end 40 for fastening the handle 140 to the first roller 12. It should be appreciated that the handle 140 can be formed having other shapes besides a lever arm, such as for example a wheel, among others.

The ratchet mechanism 150 can be any suitable known ratchet mechanism for providing engaged action in a first direction and a freewheeling action in a second direction. The engaged action turns the first roller 12 in a first rotational direction $R_1$ as the handle is moved in a first direction $H_1$. The freewheeling action enables the handle to be moved in a second direction $H_2$, opposite the first direction $H_1$, without turning the first roller 12. The ratchet mechanism 150 enables the user to move the handle 140 in one direction $H_1$, for example by pushing down on the grab surface 146 with a force $F_{H1}$, and rotate the rollers 12, 14 for pressing and then pull the handle back up while not rotating the rollers. This allows the handle 140 to be placed in a convenient orientation, such as the top of a stroke, for the user to apply sufficient force to the handle to rotate rollers and generate the press forces P without tipping the press over. As the handle 140 reaches the bottom of the stroke, the ratchet mechanism's freewheeling action allows the user to easily move the handle back up to the top of the stroke without turning the rollers 12, 14.

The ratchet mechanism 150 includes reverse action means 156 for reversing the direction of the engaged action and the freewheeling action. The reverse action means can include a button 156 extending from the ratchet mechanism 150 for moving one or more pawls (now shown) disposed within the ratchet mechanism from a first position to a second position for engaging and/or disengaging with gear teeth (not shown) to reverse the direction of the engaged action and freewheeling action as is known in the art. Ratchet mechanisms 150 having reverse action means suitable for use herein can be found on open end ratchet wrenches, examples of which are disclosed in U.S. Pat. No. 2,578,686 which is hereby totally incorporated herein by reference.

Engaging the reverse action means 156 enables the user to turn the first roller 12 in a second rotational direction $R_2$ by moving the handle 140 in the second direction $H_2$. The ratchet mechanism 150 will now freewheel, and thus, not turn the first roller 12, as the handle 140 is moved in the first direction $H_1$. This enables the user to move the media 16 out of the press in a direction opposite the feed direction FD.

Referring now to FIGS. 3 and 7 the operation of the press 10 shall be described. The media 16 is placed against the template 17 and both are placed between rigid platen plates 232 and 234. The template 17 can be a die for die cutting the media 16, a multifunction die capable of die cutting and embossing, an embossing die for embossing, or some other object for embossing the media. The platen plates 232, 243 can be formed of high density polyethylene or other rigid materials suitable for distributing the press forces P, but can be somewhat resilient to be capable of regularly coming into contact with cutting surfaces on the template 17 without prematurely dulling them. An elastomeric press pad 222 can also be placed between the media 16 and the platen plate 232 for adjusting the press force characteristics produced during pressing as is described in co-pending U.S. application Ser. No. 10/814,003, filed Mar. 31, 2004 and co-pending U.S. application Ser. No. 11/049,443 filed Feb. 2, 2005 both of which are hereby totally incorporated herein by reference.

The stack of materials to be pressed 16, 17, 222, 232, and 234, are placed on the feed bed surface 93 and against the rollers 12 and 14. The user then applies a force $F_{H1}$ to the handle 140 moving the handle in the first direction $H_1$. The ratchet mechanism 150 transfers the force $F_{H1}$ to the first roller 12 turning the roller in a first rotational direction $R_1$. The gear set 60 transfers rotational forces to the second roller 14 turning the second roller in a second rotational direction $R_2$, opposite the first rotational direction $R_1$. The first and second rollers, turning in opposite directions, pull the stack of materials between the rollers in the feed direction FD as shown in FIG. 7. As the materials move between the rollers 12 and 14, press forces P are generated, pressing the materials together. The press forces P press the media against the template and embellish the media by embossing and/or cutting it.

As described above, the freewheeling action of the ratchet mechanism 150 enables the handle 140 to be easily moved in the second direction $H_2$ from the bottom of the stroke back to the top for another application of downward force $F_{H1}$. In this manner, the handle 140 can be moved up and down for several strokes, moving the materials through the press 10 from the feed bed 92 to the exit bed 106. The ratchet mechanism 150 allows the use of a handle 140 having a relatively long lever arm 142, longer than the distance between the first roller axis A1 and the surface supporting the press, such as a table or the like (not shown), which can enable larger rotational forces to be transferred to the rollers 12 and 14. Further, the ratchet mechanism 150 also enables the handle 140 to be directly mounted to the first roller 12 for simplicity and strength. Also, the ratchet mechanism 150 enables the rollers 12, 14 to be mounted low in the press 10 thereby increasing the stability of the press 10 as a user applies large forces $F_{H1}$ and $F_{H2}$ to the handle.

The pressed materials exit from between the roller press members 12, 14 along the exit bed 106. If the user desires to reverse the direction of the pressed materials in order to back them out of the press in a direction opposite the feed direction FD, the reverse action means 156 can be engaged and the first roller 12 can be moved in the second rotational direction $R_2$ by moving the handle in the second direction $H_2$.

The press 10 is relatively compact in size and lightweight, and is therefore portable. The features described above provide for a simple yet effective press for embellishing media.

The invention has been described with reference to preferred embodiments. Obviously, modifications and alterations will occur to others upon reading and understanding the preceding specification. It is intended that the invention be construed as including all such modifications and alterations insofar as they come within the scope of the appended claims or the equivalents thereof.

I claim:

1. A roller press for embellishing media comprising:

a first roller having a radially outer press surface and a first end having keyed surface;

a second roller having a radially outer press surface spaced apart from the first roller press surface for pressing with the press surfaces and a first end having keyed surface;

a handle connected to the first roller;

a ratchet mechanism connected to the first roller, the ratchet mechanism having engaged action turning the first roller in a first rotational direction $R_1$ as the handle is moved in a first direction $H_1$ and freewheeling action thereby not turning the first roller as the handle is moved in a second direction $H_2$ opposite the first direction $H_1$; and a gear set connecting the first and second rollers transferring rotational forces therebetween turning the second roller in a rotational direction opposite the first roller for moving the media between the rollers for pressing, the gear set including:

a first gear having gear teeth and a mating surface with a shape complimentary to the first roller keyed surface abutting the first roller keyed surface providing a force transferring connection between the first gear and the first roller, and a second gear having gear teeth meshing with the first gear teeth providing a force transferring connection therebetween and a mating surface with a shape complimentary to the second roller keyed surface abutting the second roller keyed surface providing a force transferring connection between the second gear and the second roller.

2. The roller press defined in claim 1 wherein the ratchet mechanism includes reverse action means reversing the direction of the engaged action and the freewheeling action, the ratchet mechanism thereby having freewheeling action not turning the first roller as the handle is moved in the first direction $H_1$ and engaged action turning the first roller in a second rotational direction $R_2$ as the handle is moved in the second direction $H_2$.

3. The roller press defined in claim 1 wherein the first and second rollers each have a convex shaped radially outer press surface with a central diameter larger than the end diameters.

4. The roller press defined in claim 3 wherein the roller press surfaces have central diameters that are about 3% to about 6% larger than the end diameters.

5. The roller press defined in claim 1 wherein the roller press surfaces are knurled.

6. The roller press defined in claim 1 wherein the rollers are formed of steel.

7. The roller press defined in claim 6 wherein the rollers are formed of 1144 steel.

8. The roller press defined in claim 1 further comprising bearing blocks having bearings supporting the first and second rollers for rotation.

9. The roller press defined in claim 8 wherein the ratchet mechanism has a mating surface and the first roller has a first end extending through one of the bearing blocks, the first end having a keyed surface extending from the one of the bearing blocks and abutting the mating surface providing a force transferring connection between the ratchet mechanism and the first roller press member.

10. The roller press defined in claim 8 wherein the gear set is disposed within at least one of the bearing blocks.

11. The roller press defined in claim 8 further comprising:

a feed bed connected to the bearing blocks supporting media for movement in a feed direction towards the rollers, the feed bed having a first end disposed adjacent to the rollers and a second end disposed opposite the first end providing a base for supporting the press; and an exit bed connected to the bearing blocks for supporting media for movement away from the rollers, the exit bed having a first end disposed adjacent to the rollers opposite the feed bed and a second end disposed opposite the first end providing a base for supporting the press.

12. The roller press defined in claim 11 wherein the feed bed and exit bed slope downwards moving from the first ends towards the second ends.

13. A roller press for embellishing media comprising:

a pair of spaced apart bearing blocks;

a first roller press member supported by the bearing blocks for rotation about an axis, the first roller press member having a radially outer press surface;

a second roller press member supported by the bearing blocks for rotation about an axis, the second roller press member having a radially outer press surface spaced apart from the first roller press surface for pressing media therebetween;

a handle for receiving rotational forces applied by a user and connected to at least one of the first and second roller for transferring rotational forces thereto;

a feed bed connected to the bearing blocks having a flat feed surface for supporting media thereon for movement in a feed direction towards the rollers, the feed bed having a first end disposed adjacent to the second roller such that the second roller extends below the feed bed and a second end disposed opposite the first end providing a base for supporting the press; and an exit bed connected to the bearing blocks having a flat exit surface for supporting media thereon for movement away from the rollers, the exit bed having a first end disposed adjacent to the second roller opposite the feed bed such that the second roller extends below the exit bed and a second end disposed opposite the first end providing a base for supporting the press.

14. The roller press defined in claim 13 wherein the first roller includes a convex shaped radially outer roller press surface having a central diameter that is about 3% to about 6% larger than the end diameters.

15. The roller press defined in claim 13 wherein the first roller is hollow.

16. The roller press defined in claim 13 wherein the first roller press surface and the second roller press surface are convex shaped with central diameters that are larger than the end diameters.

17. The roller press defined in claim 13 further comprising a gear set connecting the first and second rollers for turning the second roller in a rotational direction opposite of the first roller for moving the media between the rollers for pressing.

18. The roller press defined in claim 13 wherein the feed bed and exit bed slope downward moving from the first ends towards the second ends.

19. The roller press defined in claim 18 wherein the feed bed second end and the exit bed second end form a base for supporting the press.

20. The roller press defined in claim 19 wherein the feed bed second end and the exit bed second end include feet.

21. The roller press defined in claim 13 wherein the feed bed first end and the exit bed first end are received in grooves formed in the bearing blocks.

22. A roller press for embellishing media comprising:

a pair of spaced apart bearing blocks;

a first roller supported by the bearing blocks for rotation about an axis, the first roller having a convex shaped radially outer press surface with a central diameter that is larger than the end diameters and an end having a keyed surface;

a second roller supported by the bearing blocks for rotation about an axis, the second roller having a convex shaped radially outer press surface with a central diameter that is larger than the end diameters and spaced apart from the first roller press surface for pressing and an end having a keyed surface;

a handle having a ratchet mechanism connected to the first roller, the ratchet mechanism having engaged action turning the first roller in a first rotational direction $R_1$ as the handle is moved in a first direction $H_1$ and freewheeling action thereby not turning the first roller as the handle is moved in a second direction $H_2$ opposite the first direction $H_1$; and a gear set connecting the first and second rollers turning the second roller in a rotational direction opposite the first roller for moving the media between the rollers for pressing, the gear set including a first gear having a mating surface with a shape complimentary to the first roller keyed surface abutting the keyed surface for providing a force transferring connection therebetween and gear teeth, the gear set including a second gear having gear teeth meshing with the first gear teeth for providing a force transferring connection therebetween and a mating surface with a shape complimentary to the second roller keyed surface abutting the second roller keyed surface for providing a force transferring connection therebetween.

23. The roller press defined in claim 22 wherein the press is a paper and cardstock cutting and embossing press.

24. The roller press defined in claim 22 wherein the press is a foil cutting and embossing press.

25. A roller press for embellishing media comprising a first roller having a press surface and an end having a keyed surface;

a second roller having a press surface and an end having a keyed surface;

a first gear having an aperture with a mating surface with a shape complimentary to the first roller keyed surface and gear teeth, the mating surface abutting the first roller keyed surface for providing a force transferring connection therebetween; and a second gear having gear teeth meshing with the first gear teeth providing a force transferring connection therebetween turning the second roller in a rotational direction opposite of the first roller, the second gear having an aperture with a mating surface with a shape complimentary to the second roller keyed surface abutting the second roller keyed surface for providing a force transferring connection therebetween.

26. The roller press defined in claim 25 further comprising spaced apart bearing blocks supporting the first and second rollers for rotation, the first roller keyed surface extending from the one of the bearing blocks and abutting the ratchet mechanism mating surface providing a force transferring connection between the ratchet mechanism and the first roller press member.

27. The roller press defined in claim 26 further wherein the first gear and second gear are received in one of the bearing blocks.

28. The roller press defined in claim 25 further comprising:

the first roller having a first cylindrical surface and a second cylindrical surface supporting the first roller for rotation about a first axis, the first and second cylindrical surfaces being spaced apart with the first roller press surface disposed therebetween; and the second roller having a first cylindrical surface and second cylindrical surface supporting the second roller for rotation about a second axis, the first and second cylindrical surfaces being spaced apart with the second roller press surface disposed therebetween.

29. The roller press defined in claim 28 further comprising:

the first roller having the second cylindrical surface disposed between the press surface and the keyed surface; and the second roller having the second cylindrical surface disposed between the press surface and the keyed surface.

30. The roller press defined in claim 29 further comprising:

the first roller first and second cylindrical surfaces being received in bearings disposed in bearing blocks, and the second roller first and second cylindrical surfaces being received in bearings disposed in bearing blocks.

31. The roller press defined in claim 28 further comprising:

a handle having lever arm including an aperture receiving the first roller keyed surface, the aperture having a mating surface with a shape complementary to the first roller keyed surface abutting the first roller keyed surface transferring rotational forces applied to the handle by a user to the first roller for rotating the first roller.

32. The roller press defined in claim 31 further comprising:

the handle including a ratchet mechanism disposed at an end of the lever arm, the ratchet mechanism having the aperture receiving the first roller keyed surface providing a force transferring connection between the handle and the first roller with engaged action turning the first roller in a first rotational direction $R_1$ as the handle is moved in a first direction $H_1$ and freewheeling action thereby not turning the first roller as the handle is moved in a second direction $H_2$ opposite the first direction $H_1$.

33. The roller press defined in claim 32 wherein the ratchet mechanism includes reverse action means enabling the ratchet mechanism to turn the first roller in a second rotational direction $R_2$ as the handle is moved in the second direction $H_2$ and to not turn the first roller as the handle is moved in the first direction $H_1$.

* * * * *